US011092125B2

(12) United States Patent
Schmieder et al.

(10) Patent No.: US 11,092,125 B2
(45) Date of Patent: Aug. 17, 2021

(54) VALVE FOR METERING A FLUID, IN PARTICULAR, A FUEL INJECTOR

(71) Applicant: Robert Bosch GmbH, Stuttgart (DE)

(72) Inventors: Dietmar Schmieder, Markgroeningen (DE); Corren Heimgaertner, Schwieberdingen (DE); Kai Gartung, Stuttgart (DE); Kilian Groh, Schesslitz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/955,528

(22) PCT Filed: Oct. 29, 2018

(86) PCT No.: PCT/EP2018/079545
§ 371 (c)(1),
(2) Date: Jun. 18, 2020

(87) PCT Pub. No.: WO2019/129412
PCT Pub. Date: Jul. 4, 2019

(65) Prior Publication Data

US 2021/0010448 A1 Jan. 14, 2021

(30) Foreign Application Priority Data

Dec. 29, 2017 (DE) ..... 102017223866.6

(51) Int. Cl.
*F02M 55/00* (2006.01)
*F02M 51/06* (2006.01)
(Continued)

(52) U.S. Cl.
CPC ..... *F02M 55/004* (2013.01); *F02M 51/061* (2013.01); *F02M 61/166* (2013.01); *F02M 61/1853* (2013.01); *F02M 61/1886* (2013.01)

(58) Field of Classification Search
CPC .. F02M 55/004; F02M 51/061; F02M 61/166; F02M 61/1853; F02M 61/1886
(Continued)

(56) References Cited

U.S. PATENT DOCUMENTS 4,951,878 A 8/1990 Casey et al.
5,613,640 A * 3/1997 Furuya ..... F02M 51/0671 239/585.5
(Continued)

FOREIGN PATENT DOCUMENTS

DE 19533290 A1 3/1996
DE 102005052255 A1 5/2007
DE 102007051585 A1 4/2009

OTHER PUBLICATIONS

International Search Report for PCT/EP2018/079545, dated Dec. 19, 2018.

*Primary Examiner* — Mahmoud Gimie
(74) *Attorney, Agent, or Firm* — Norton Rose Fulbright US LLP; Gerard Messina

(57) ABSTRACT

A valve, in particular, a fuel injector, has an improved sealing at its spray-side end. The fuel injector includes an excitable actuator for actuating a valve closing body, which together with a valve seat surface formed on a valve seat body forms a seal seat, and spray openings formed downstream of the valve seat surface, and a valve seat support, which accommodates the valve seat body, forms a portion of a valve housing and is fixedly connected to the valve seat body. A plastically deformable sealing element is introduced into an annular gap between the valve seat support and the valve seat body to avoid corrosion and damage of a weld seam.

14 Claims, 5 Drawing Sheets

(51) Int. Cl.
*F02M 61/18* (2006.01)
*F02M 61/16* (2006.01)

(58) Field of Classification Search
USPC ..... 123/294, 490
See application file for complete search history.

(56) References Cited

U.S. PATENT DOCUMENTS

| | | | | |
|---|---|---|---|---|
| 5,755,386 | A | 5/1998 | Lavan et al. | |
| 5,785,024 | A | 7/1998 | Takei et al. | |
| 6,015,103 | A * | 1/2000 | Kotkowicz | F02M 51/0671 239/533.11 |
| 2001/0015418 | A1* | 8/2001 | Reiter | F02M 61/168 251/129.21 |
| 2003/0010847 | A1* | 1/2003 | Curran | F02M 55/04 239/585.1 |
| 2015/0285390 | A1* | 10/2015 | Grau | F16J 15/3284 123/188.4 |
| 2019/0107092 | A1* | 4/2019 | Schmieder | F02M 61/14 |
| 2019/0107093 | A1* | 4/2019 | Schmieder | F02M 61/168 |

* cited by examiner

VALVE FOR METERING A FLUID, IN PARTICULAR, A FUEL INJECTOR

FIELD

The present invention is directed to a valve for metering a fluid, in particular, a fuel injector.

BACKGROUND INFORMATION

FIG. 1, by way of example, shows a conventional fuel injection device in which a fuel injector installed in a receiving borehole of a cylinder head of an internal combustion engine is provided. The fuel injection device is particularly suitable for use in fuel injection systems of mixture-compressing, spark ignition internal combustion engines. The valve includes a valve housing which, among other things, includes a valve seat support which accommodates a valve seat body and is fixedly connected to the valve seat body. The two components are fixedly connected to one another with the aid of a weld seam. In the assembled state, the valve seat body rests against an inner stop shoulder of the valve seat support, whereby a radial annular gap remains at the outer circumference of the two components between these (e.g., German Patent Application No. DE 10 2005 052 255 A1).

SUMMARY

An example valve according to the present invention for metering a fluid may have the advantage of an improved sealing of valve housing components at its spray-side valve end, which, when the valve is implemented as a direct-injecting fuel injector, is influenced by the aggressive combustion chamber atmosphere due to the immediate vicinity with respect to the combustion chamber. According to an example embodiment of the present invention, a plastically deformable sealing element is introduced into an annular gap between a valve seat support and a valve seat body. The compressed sealing element ensures that no ingress of moisture and other corrosive media into the annular gap at the spray-side valve end is possible. In this respect, it is advantageously ensured that the quality of the weld seam in the axial overlapping area of the valve seat support and the valve seat body is not impaired. All risks with respect to corrosion in the weld seam vicinity, and component impairments and changes in the installation position of the valve seat body resulting therefrom, are precluded.

The measures described herein allow advantageous refinements of and improvements on the example valve according to the present invention.

It is particularly advantageous, during the installation of the valve seat body in the valve seat support, to apply such a pressing or pretensioning force F in the axial direction which plastically deforms and thus compresses the sealing element in the annular gap that its axial extension is decreased, but in return an expansion occurs in the radial direction, to create an optimal sealing, without the sealing element being deformed beyond a critical limit.

BRIEF DESCRIPTION OF THE DRAWINGS

Exemplary embodiments of the present invention are shown in a simplified manner in the figures and are described in greater detail below.

DETAILED DESCRIPTION OF EXAMPLE EMBODIMENTS

Figure 1:
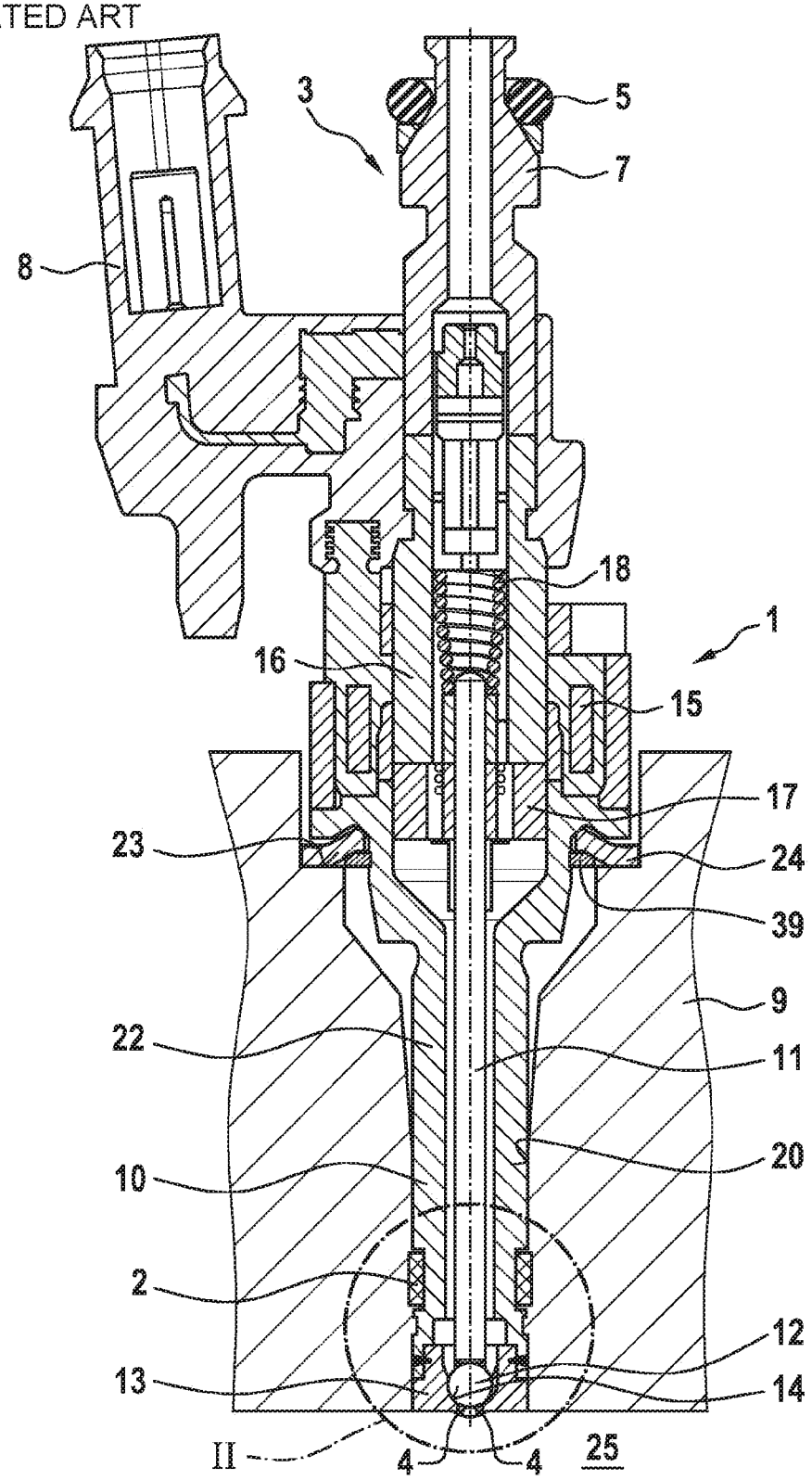
Fig. 1 RELATED ART
FIG. 1 shows a schematic sectional view through a fuel injector in a conventional embodiment including a valve seat body, having spray openings, at the downstream valve end.

An example of a conventional fuel injector 1 shown in FIG. 1 is implemented in the form of a fuel injector 1 for fuel injection systems of mixture-compressing, spark ignition internal combustion engines. Fuel injector 1 is suitable, in particular, for directly injecting fuel into a combustion chamber 25 of an internal combustion engine, which is not shown in greater detail. In general, the present invention is applicable to valves for metering a fluid.

With a downstream end, fuel injector 1 is installed into a receiving borehole 20 of a cylinder head 9. A sealing ring 2, in particular, made up of Teflon®, ensures an optimal sealing of fuel injector 1 with respect to the wall of receiving borehole 20 of cylinder head 9.

At its inlet-side end 3, fuel injector 1 includes a plug connection to a fuel distributor line, which is not shown, which is sealed by a sealing ring 5 between a connecting piece of the fuel distributor line and an inlet connector 7 of fuel injector 1. Fuel injector 1 includes an electrical connector plug 8 for the electrical contacting for actuating fuel injector 1.

A decoupling element 24, which is used to compensate for manufacturing and assembly tolerances and ensures a transverse force-free mounting, even with a slightly oblique position of fuel injector 1, is inserted between a valve housing 22 and a shoulder 23 of receiving borehole 20 extending, e.g., at a right angle to the longitudinal extension of receiving borehole 20. Moreover, an optimized noise decoupling thus takes place. Decoupling element 24 is secured, e.g., with the aid of a retaining washer 39.

Valve housing 22 of fuel injector 1 is formed, among other things, by inlet connector 7, but also by a nozzle body 10 in which a valve needle 11 is situated. Valve needle 11 is operatively connected to an, e.g., ball-shaped valve closing body 12, which cooperates with a valve seat surface 14 situated at a valve seat body 13 to form a seal seat. In the exemplary embodiment, fuel injector 1 is an inwardly opening fuel injector 1, which has at least one spray opening 4, but typically at least two spray openings 4. Ideally, however, fuel injector 1 is implemented as a multi-hole injector and thus has between four and thirty spray openings 4.

An electromagnetic circuit serves as a drive, e.g., which includes a solenoid coil 15 as an actuator, which is encapsulated in a coil housing and wound on a coil support, which surrounds an inner pole 16. The electromagnetic circuit furthermore includes an armature 17, which is situated on valve needle 11. In the rest state of fuel injector 1, armature 17 is acted upon by a return spring 18 counter to its lift direction in such a way that valve closing body 12 is held in sealing contact at valve seat surface 14. When excited, solenoid coil 15 builds up a magnetic field, which moves armature 17 against the spring force of return spring 18 in the lift direction. Armature 17 also carries valve needle 11 along in the lift direction. Valve closing body 12 connected to valve needle 11 lifts off valve seat surface 14, and the fuel is sprayed through spray openings 4.

When the coil current is switched off, armature 17 drops off inner pole 16 after the magnetic field has been sufficiently reduced due to the pressure of return spring 18, by which valve needle 11 moves counter to the lift direction. As a result, valve closing body 12 hits on valve seat surface 14, and fuel injector 1 is closed.

This design of the fuel injection device is a system for the fuel direct injection using fuel injectors 1 which, as shown, are operated with the aid of an electromagnetic actuator, but also with the aid of piezoelectric actuators, and, e.g., are used in a constant pressure system.

Nozzle body 10 is a valve component, which may also be referred to as a valve seat support since it accommodates valve seat body 13.

Figure 2:
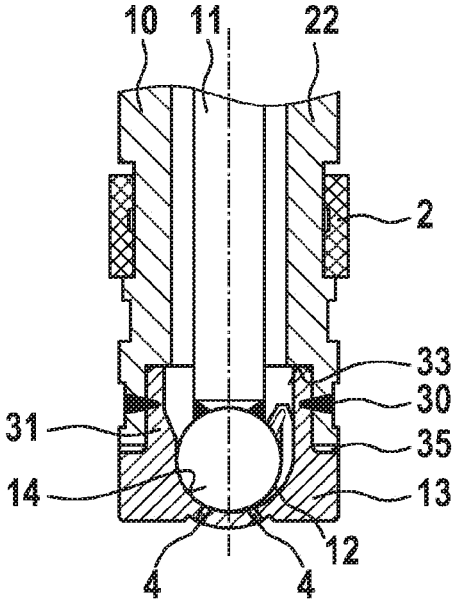
Fig. 2 RELATED ART
FIG. 2 shows the outlet-side valve end as a section II of FIG. 1 in an enlarged illustration.

FIG. 2 shows the outlet-side valve end as a section II of FIG. 1 in an enlarged illustration. Valve seat support 10 and valve seat body 13 are fixedly connected to one another, usually with the aid of a weld seam 30, which is created in the circumferential direction at the outer circumference of valve seat support 10, e.g., with the aid of a laser. On its side opposite spray openings 4, valve seat body 13 includes an annular collar 31, which has such an outside diameter that it may be inserted into an inner opening of valve seat support 10 in an accurately fitting manner. Weld seam 30 is placed exactly in the overlapping area of annular collar 31 of valve seat body 13 with valve seat support 10. Valve seat body 13 is pushed so far into valve seat support 10 in the conventional manner until annular collar 31 strikes against a stop shoulder 33 of valve seat support 10. To reliably reach this stop and the corresponding positioning and be able to apply weld seam 30 process-reliably, annular collar 31 of valve seat body 13 is provided with an axial length which is slightly larger than the length of the inner opening of valve seat support 10, proceeding from stop shoulder 33 in the downstream direction. In this way, it is avoided that a disadvantageous impact of the components including valve seat support 10 and valve seat body 13 occurs elsewhere. However, this dimensioning also means that an annular gap 35 is formed between valve seat support 10 and valve seat body 13 in the outer circumferential area.

Such an annular gap 35 at the spray-side valve end, however, may have the disadvantage that, in addition to the aggressive combustion chamber atmosphere, an ingress of moisture and other corrosive media is also possible, which in the extreme case results in corrosion at the components including valve seat support 10 and valve seat body 13 in the annular gap vicinity and may impair the quality of weld seam 30 in the axial overlapping area of valve seat support 10 and valve seat body 13. This would disadvantageously and undesirably affect the quality of the fixed connection of valve seat support 10 and valve seat body 13 and possibly no longer leave valve seat body 13 in the exactly correct installation position.

According to the present invention, a deformable sealing element 45 is introduced into annular gap 35 between valve seat support 10 and valve seat body 13.

Figure 3:
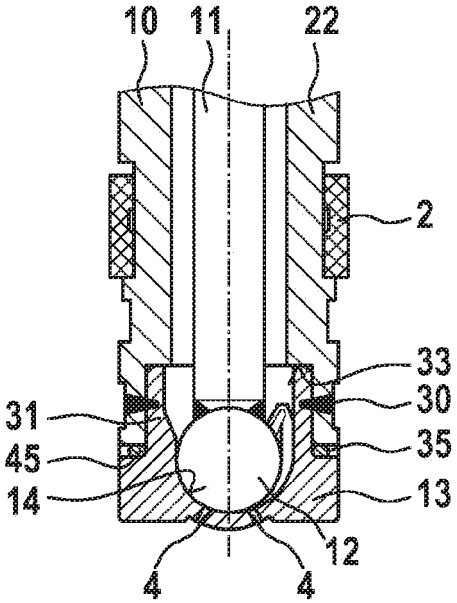
FIG. 3 shows a first exemplary embodiment according to the present invention of a valve end in a sectional illustration similar to FIG. 2, including a first sealing element between the valve seat body and the valve seat support.

FIG. 3 shows a first exemplary embodiment according to the present invention of a valve end in a sectional illustration similar to FIG. 2, including a first sealing element 45 between valve seat body 13 and valve seat support 10. Valve seat body 13 is thus sealed with respect to valve seat support 10 by an axial seal in such a way that no corrosive medium is able to reach radial annular gap 35 or weld seam 30. In the example according to FIG. 3, an annular sealing element 45 having a round cross section is used. Such an annular ring may be made up of a material such as a corrosion-resistant soft iron (1.4511 or 1.4307 soft annealed), copper, brass, bronze, aluminum or the like. The material should be selected in such a way that sealing element 45 is axially plastically deformable during the installation of valve seat body 13 at valve seat support 10. As is shown in FIG. 3, the originally round sealing element 45 has an oval cross section in the installed state since sealing element 45, due to a pretensioning force F acting on valve seat body 13 during the installation, experiences a plastic deformation in the axial direction, the material of sealing element 45 yielding in the radial direction in annular gap 35, and overall resulting in this "contorted" shape. The plastic deformation of sealing element 45 ensures a further improvement of the sealing properties of sealing element 45. Weld seam 30 is only applied after the plastic deformation of sealing element 45.

For installation reasons, sealing element 45 implemented as an annular ring should have an inside diameter, in the undeformed state, which is approximately the same size as the outside diameter of valve seat body 13 in the area of its annular collar 31. The inside diameter of sealing element 45 may, of course, also be slightly larger than the outside diameter of valve seat body 13 in the area of its annular collar 31. If the transition zone to annular collar 31 at valve seat body 13 is rounded, it is advantageous to provide sealing element 45 with a radius which largely corresponds to the radius of the rounding of the transition zone.

Figure 4A:
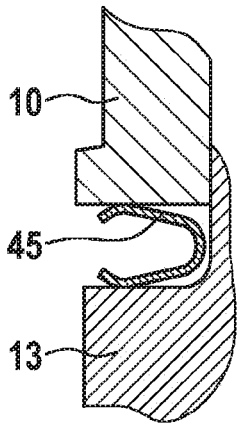
FIGS. 4A and 4B show a second embodiment according to the present invention of a sealing element between the valve seat body and the valve seat support.
Figure 4B:
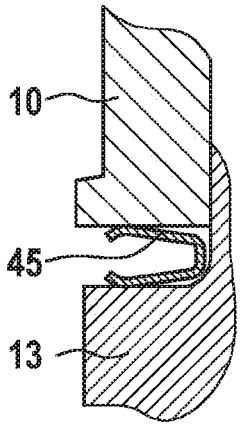

FIGS. 4A and 4B show a second embodiment according to the present invention of a sealing element 45 between valve seat body 13 and valve seat support 10, sealing element 45 in FIG. 4A being shown undeformed before the axial pressing, whereas FIG. 4B shows sealing element 45 deformed after the axial pressing. In this exemplary embodiment, sealing element 45 is manufactured, e.g., from a corrosion-resistant spring steel, such as 1.4310. Sealing element 45 has a flat U-profile in the cross section. Only small pretensioning forces F are needed here for the axial plastic deformation.

Figure 5A:
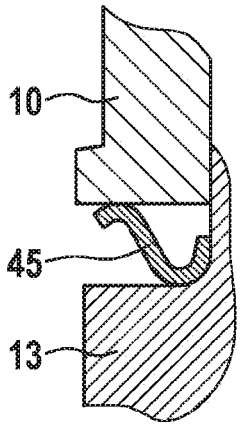
FIGS. 5A and 5B show a third embodiment according to the present invention of a sealing element between the valve seat body and the valve seat support.
Figure 5B:
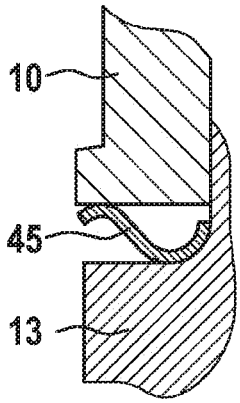

FIGS. 5A and 5B show a third embodiment according to the present invention of a sealing element 45 between valve seat body 13 and valve seat support 10, sealing element 45 in FIG. 5A being undeformed before the axial pressing, whereas FIG. 5B shows sealing element 45 deformed after the axial pressing. In this exemplary embodiment, sealing element 45 is manufactured, e.g., from a corrosion-resistant spring steel, such as 1.4310. Sealing element 45 has a wave-shaped profile in the cross section. Only small pretensioning forces F are also needed here for the axial plastic deformation.

Figure 6A:
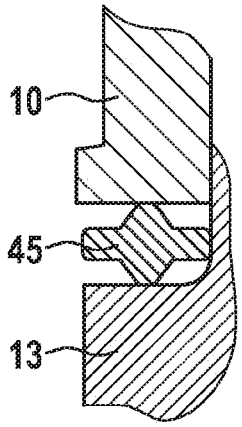
FIGS. 6A and 6B show a fourth embodiment according to the present invention of a sealing element between the valve seat body and the valve seat support.
Figure 6B:
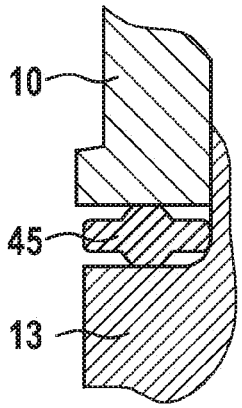

FIGS. 6A and 6B show a fourth embodiment according to the present invention of a sealing element 45 between valve seat body 13 and valve seat support 10, sealing element 45 in FIG. 6A being undeformed before the axial pressing, whereas FIG. 6B shows sealing element 45 deformed after the axial pressing. Sealing element 45 is a stamped part having a cross-shaped cross section, for example, in which the axially extending cross legs are plastically contorted during the axial pressing. Other contours for sealing elements 45 as stamped parts are also possible.

Steel may be used as a typical material for valve seat body 13. The manufacture may thus take place with the aid of machining (e.g., turning, grinding, honing), with the aid of forming (e.g., impact extrusion) or also with the aid of primary shaping (e.g., metal injection molding) or with the aid of 3D printing. Apart from steel, however, other metallic materials or ceramic materials are also possible for valve seat body 13.

What is claimed is:

1. A valve for metering a fluid, comprising:

an excitable actuator configured to actuate a valve closing body, the valve closing body together with a valve seat surface formed on a valve seat body forming a seal seat;

at least one spray opening formed downstream of the valve seat surface;

a valve seat support, which accommodates the valve seat body, forms a portion of a valve housing and is fixedly connected to the valve seat body; and a deformable sealing element situated in an annular gap between the valve seat support and the valve seat body;

wherein the valve is a fuel injector for directly injecting fuel into a combustion chamber for a fuel injection system of an internal combustion engine, and wherein the valve seat body, on its side opposite the spray openings, includes an annular collar, which is inserted into an inner opening of the valve seat support and, in an installed state, rests against a stop shoulder of the valve seat support, the annular gap being formed in an outer circumferential area of the valve seat support and the valve seat body, being formed at an outer circumference of the fuel injector, and being open to outside of the fuel injector.

2. The valve as recited in claim 1, wherein the sealing element is plastically deformed in an installed state compared to a state before installation of the sealing element.

3. The valve as recited in claim 2, wherein the sealing element has an annular shape having a round cross section in its undeformed state.

4. The valve as recited in claim 1, wherein the sealing element is made of a material including: a corrosion-resistant soft iron, or copper, or brass, or bronze, or aluminum.

5. The valve as recited in claim 4, wherein the corrosion-resistant soft iron is 1.4511 or 1.4307 soft annealed.

6. The valve as recited in claim 1, wherein the sealing element is an annular shaped spring steel sheet and has, in its cross section, a C profile or a U profile or a wave profile.

7. The valve as recited in claim 6, wherein the sealing element is made of a corrosion-resistant spring steel.

8. The valve as recited in claim 7, wherein the steel is 1.4310.

9. The valve as recited in claim 1, wherein the sealing element is an annular shaped stamped part.

10. The valve as recited in claim 9, wherein the sealing element has a cross-shaped cross section.

11. The valve as recited in claim 1, wherein the valve seat support and the valve seat body are fixedly connected to one another using a weld seam.

12. The valve as recited in claim 11, wherein the annular collar of the valve seat body is welded to the valve seat support by the weld seam in an area of the annular collar that is further from the spray openings of the fuel injector than the annular gap is from the spray openings.

13. The valve as recited in claim 1, wherein the sealing element is an annular shaped spring steel sheet and has, in its cross section, a C profile, the C being open to the outside of the fuel injector.

14. The valve as recited in claim 13, wherein the sealing element is made of a material including: a corrosion-resistant soft iron, or copper, or brass, or bronze, or aluminum.

* * * * *